US006578731B1

(12) United States Patent
Lewis et al.

(10) Patent No.: US 6,578,731 B1
(45) Date of Patent: Jun. 17, 2003

(54) SYSTEM FOR DISPENSING WIPES

(75) Inventors: Richard Paul Lewis, Marietta, GA (US); Craig Farrell Thomaschefsky, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 91 days.

(21) Appl. No.: 09/718,055

(22) Filed: Nov. 21, 2000

(51) Int. Cl.[7] ..... B65H 1/00

(52) U.S. Cl. ..... 221/46; 221/61; 221/63; 221/64

(58) Field of Search ..... 221/33, 46, 61, 221/63, 64, 281; 206/554, 493, 494; 211/54.1, 57.1

(56) References Cited

U.S. PATENT DOCUMENTS

| | | | | |
|---|---|---|---|---|
| 3,967,756 A | | 7/1976 | Barish | |
| 4,002,264 A | * | 1/1977 | Marchesani | 221/63 |
| 4,131,195 A | | 12/1978 | Worrell, Sr. | |
| 4,156,493 A | | 5/1979 | Julius | |
| 4,185,754 A | | 1/1980 | Julius | |
| 4,192,420 A | | 3/1980 | Worrell, Sr. et al. | |
| 4,387,832 A | | 6/1983 | Margulies | |
| 4,526,291 A | | 7/1985 | Margulies | |
| 4,550,855 A | | 11/1985 | Harrison | |
| 4,863,064 A | | 9/1989 | Dailey, II | |
| 5,657,900 A | * | 8/1997 | Scherr | 221/45 |
| 5,688,394 A | * | 11/1997 | McBride, Jr. et al. | 221/63 X |
| 5,788,378 A | | 8/1998 | Thomas | |
| 5,908,138 A | * | 6/1999 | Vlahakis et al. | 221/63 |

FOREIGN PATENT DOCUMENTS

| | | |
|---|---|---|
| DE | 9317973 | 6/1994 |
| EP | 223262 A2 | 5/1987 |
| EP | 534600 A2 | 3/1993 |
| EP | 744357 A1 | 11/1996 |

OTHER PUBLICATIONS

International Search Report, Dated Mar. 21, 2002.

* cited by examiner

*Primary Examiner*—David H. Bollinger
(74) *Attorney, Agent, or Firm*—Dority & Manning, PA

(57) ABSTRACT

A system for dispensing wipes includes: (1) a continuous web of material joined at perforations and configured into a center feed roll; and (2) a flexible, moisture impervious pouch for containing and dispensing discrete lengths of web from the roll. The pouch includes a resealable opening for accessing and staging a leading edge of the roll of material and is adapted to dispense discrete lengths of web separated from the roll at the perforations. The pouch is constructed such that its shape closely conforms to the shape of the roll of web material and may be configured with a gusset to enable it to stand without external support.

19 Claims, 3 Drawing Sheets

SYSTEM FOR DISPENSING WIPES

FIELD OF THE INVENTION

The present invention relates generally to a system for dispensing disposable wipers. More particularly the invention pertains to an improved system for retaining and dispensing wet wipes or moistened towelettes.

BACKGROUND OF THE INVENTION

The concept of premoistened sheets, towelettes, or wet wipes, for cleaning hands, is not new. Wet wipes are well known commercial consumer products that have been available in many forms. Wet wipes have been made from a variety of materials that are commonly moistened with a variety of suitable wiping solutions. They are exceedingly popular for a variety of uses such as cleaning surfaces, applying topical lotions, and treating adult and baby skin surfaces to name a few uses. One reason for their popularity is that they can be used when access to washroom facilities is not available. For example, while traveling in an automobile; while engaging in sporting activities (e.g., tennis, golf, baseball, etc.), or while participating in camping, hiking, picnicking and related activities. For wet wipes to be effectively utilized in the above situations they must be packaged so that they can be transported conveniently without excessive evaporation or leakage of the moisturizing ingredients, and without becoming contaminated.

Wet wipes designed to be transportable are dispensed from one of two general types of packaging. The first type of packaging dispenses individual sheets from a stacked arrangement of such sheets and the second type of packaging dispenses sheets from a continuous roll of such sheets.

Perhaps the most common form of packaging are the first type, i.e., a stack of moistened sheets packaged in a plastic container. Typically, these wet wipes have been available in either folded or unfolded configurations. For example, stacks of wet wipes have been available wherein each of the wet wipes in the stack has been arranged in a folded configuration such as a c-folded, z-folded or quarter-folded configuration as are well known to those skilled in the art. Each folded wet wipe has also been interfolded with the wet wipes immediately above and below in the stack of wet wipes.

The second form of packaging commonly utilizes a continuous roll type configuration, i.e., the wet wipes are in the form of continuous webs of material which include perforations to separate the individual wet wipes, which are wound into rolls and packaged in plastic containers. The present invention is drawn to this continuous roll type configuration.

Containers associated with the continuous roll type wet wipe typically comprise a hollow, plastic cylindrical dispenser. Such containers are commonly semi-rigid and manufactured from materials such as polyethylene and/or polypropylene. The containers usually have a lid or cover of some form that is attached by a hinge or is mated with the container by a threaded connection. Access to the wipes is had by removing or otherwise opening the cover and withdrawing a wipe. Occasionally a dispensing port is formed within the lid or cover. The dispensing port when provided allows for the removal of a wipe without requiring complete removal of the lid or cover. The container and lid or cover when in the closed position is designed to provide an air tight storage vessel for the wet wipes.

Packages such as the container and lid or cover described above are typically disposed in landfills when the wet wipes are consumed. The cost of such disposable packaging directly impacts the overall cost of the product. In addition, the environmental impact associated with the disposal of these packages can also be significant.

Thus, there currently remains a need for a package that provides for the airtight storage of a wet wipe that is both inexpensive to manufacture and permits the consumer to realize the same advantages associated with prior art packaging.

SUMMARY OF THE INVENTION

The present invention addresses the problems described above by providing a system for containing and dispensing discrete lengths of web from a continuous web of material. The system includes: (1) a continuous web of material joined at perforations and configured into a center feed roll; and (2) a flexible, moisture impervious dispenser or pouch for containing and dispensing discrete lengths of web from the roll. The dispenser includes a resealable opening for accessing and staging a leading edge of the roll of material and is adapted to dispense discrete lengths of web separated from the roll at the perforations.

In a desirable embodiment of the invention, the continuous web of material may comprise any suitable material, for example, paper or nonwoven material and like products. More desirably, the continuous web of material comprises a pre-moistened wet wipe or towelette.

In one aspect of the invention, the dispenser is constructed such that its shape closely conforms to the shape of the roll of web material for, at least, the purpose of minimizing the use of excess materials. Desirably the dispenser is freestanding. The dispenser may be configured with a gusset to enable it to stand without external support. In one desirable freestanding position, the resealable opening is oriented so that unobstructed access to and dispensing of discrete lengths of the web material can be readily had. The product is designed to be carried conveniently by an end user. As such, a handle can be incorporated into the dispenser.

In an embodiment of the system, the resealable opening may further include: (1) a dispensing port allowing egress of the leading edge of the roll of material from the interior of the package through the resealable opening; (2) a cap disposed over the dispensing port for selectively sealing the system from the environment or enabling dispense of a discrete length of web through the dispensing port; and (3) a chamber disposed between the cap and the dispensing port for capturing and staging the leading edge of the web for dispensing. The system may also have a flange for attaching and hermetically sealing the cap assembly to the dispenser.

An additional resealable opening may also be provided in the dispenser. The additional resealable opening is adapted for receiving therethrough the roll into an interior portion of the dispenser. The second resealable opening enables installation of a replacement roll upon exhaustion of the initial roll. Furthermore, the second resealable opening enables a user to initially stage a leading edge of the web in the chamber between the cap portion and the dispensing port for proper dispensing. The second resealable opening provides a user with the further ability to restage a leading edge of the web in the event that the leading edge slips through the dispensing port and falls back into the dispenser.

In one embodiment of the invention, the additional resealable opening may include a first portion of a continuous pressure seal formed in one face of the dispenser and a second portion of a continuous pressure seal formed in a mating face of the dispenser. By pressing the first and second portions of the continuous pressure seal together, the opening is thereby sealed from the environment.

DETAILED DESCRIPTION

Figure 1:
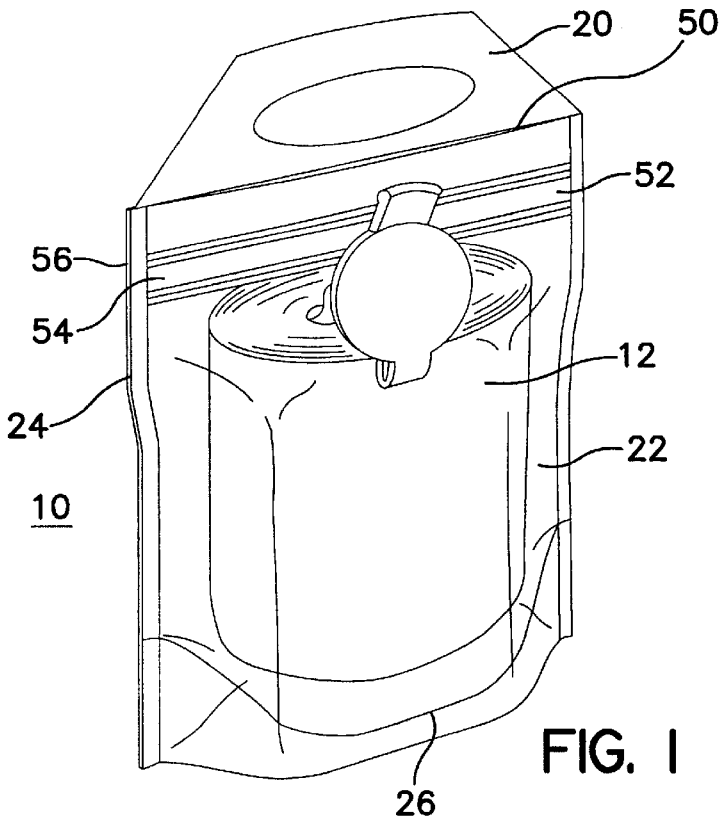
FIG. 1 is an illustration of an exemplary embodiment of a system for containing and dispensing discrete lengths of web from a continuous web of material depicting an optional carrying handle.
Figure 2:
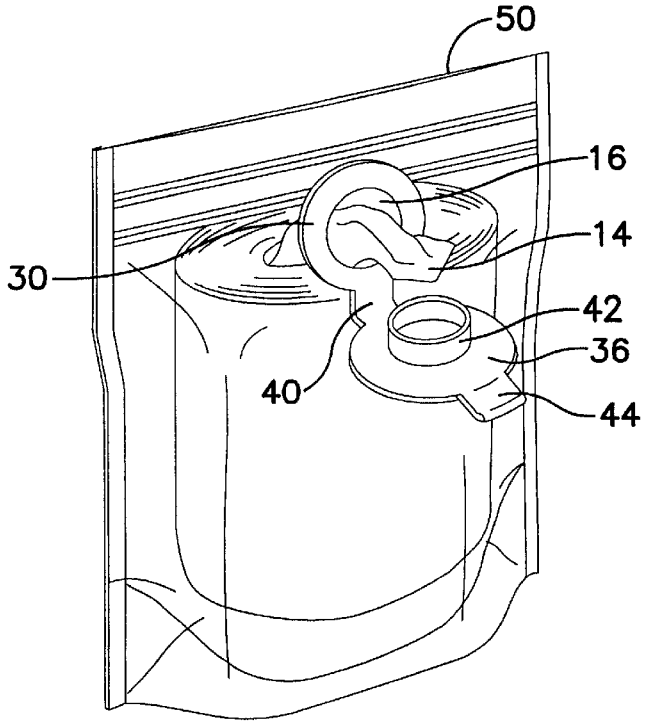
FIG. 2 is an illustration of the FIG. 1 system without the handle depicting the web in the process of being dispensed.

Referring now to the drawings, wherein like reference numerals designate corresponding structure throughout the views, and referring in particular to FIGS. 1 and 2, there is shown (not necessarily to scale) an illustration of an exemplary dispensing system comprising the present invention. The system includes a dispenser 10 and a coreless roll product 12. The dispenser 10 is used to dispense the coreless roll product 12 by center feeding a leading end 14 through an opening 16 in the dispenser portion. For the purposes of illustration and ease of explanation, the FIGs. depict the dispenser as transparent. It should be understood that the dispenser may be transparent, translucent, opaque, or have separate portions having any combination of those characteristics.

Many different types of products may be produced in a coreless roll format. For example, commercial and consumer absorbent products such as shop towels, nonwoven fabrics, wipers, bathroom tissue, paper towels, and premoistened towelettes or wet wipes are often distributed and dispensed in roll format. This invention contemplates the use of each of these roll products but it is especially desirable for dispensing a continuous web of premoistened towelettes or wet wipes. These premoistened towelettes may be joined at perforations or may be interfolded such that the trailing end of a first towelette stages a leading end of a subsequent towelette for later dispense.

Once again, looking to FIGS. 1 and 2, the dispenser 10 in one variation is in the form of a flexible, moisture impervious pouch. The dispenser 10 may be seamless and constructed as a pouch or may comprise a plurality of flexible walls joined by ultrasonic welding or other techniques that hermetically seal the flexible walls one to another. The dispenser 10 is sized to closely conform to the shape of the coreless roll product 12. It is desirable that it be sufficiently flexible to collapse upon itself as the coreless roll product is depleted thus enabling the dispenser to maintain its close conformance to the shape of the coreless roll product.

For instance, in one desirable embodiment, the dispenser 10 may comprise a first flexible wall 22, a second flexible wall 24, and a third flexible wall 26. The third flexible wall 26 could be employed in conjunction with the first and second flexible walls 22, 24 to serve as a gusset or self-supporting bottom structure. Each of the flexible walls 22, 24, and 26 is hermetically sealed to at least one other of the walls along the edges to create an air and moisture impervious environment for containing and staging the careless roll 12 of premoistened towelettes.

The term "gusset" as used in the present case merely represents that the lower end portions of the walls 22 and 24 be extended outwardly and, in essence, have the wall 26 placed between and hermetically sealed to walls 22 and 24 so as to form the generally ovoid-shaped curved bottom intermediate the walls 22 and 24 which are also bowed convexly outwardly, and thereby, especially under the weight of the careless roll 12, provide a bottom structure adapted to be self-supporting on a horizontal surface for maintaining the dispenser 10 in an upstanding upright condition. Of course, other methods exist to create a hermetically sealed self standing dispenser having an air and moisture impervious environment. One possible configuration includes extending the side walls 22 and 24 sufficient distance so that each can be folded in towards the bottom so as to form the generally ovoid-shaped curved bottom in such a manner as to eliminate the need for a separate flexible wall 26. Dispensers of this type are often referred to as Doy pouches or packets.

Looking more particularly to FIG. 2, the resealable opening 16 for accessing and staging the leading end 14 of the coreless roll 12 and for feeding lengths of the material therefrom is depicted. Since a desirable characteristic of such a dispensing system is that it hermetically seal the interior of the dispenser 10 from the outside environment, but allow for the selective breaking of the seal to access and remove a portion of the coreless roll product 12, any number of techniques may be used to configure the resealable opening 16 into the dispenser 10. For example, a suitable apparatus could be ultrasonically welded, heat sealed, and/or pressure sealed to the dispenser 10.

Figure 3:
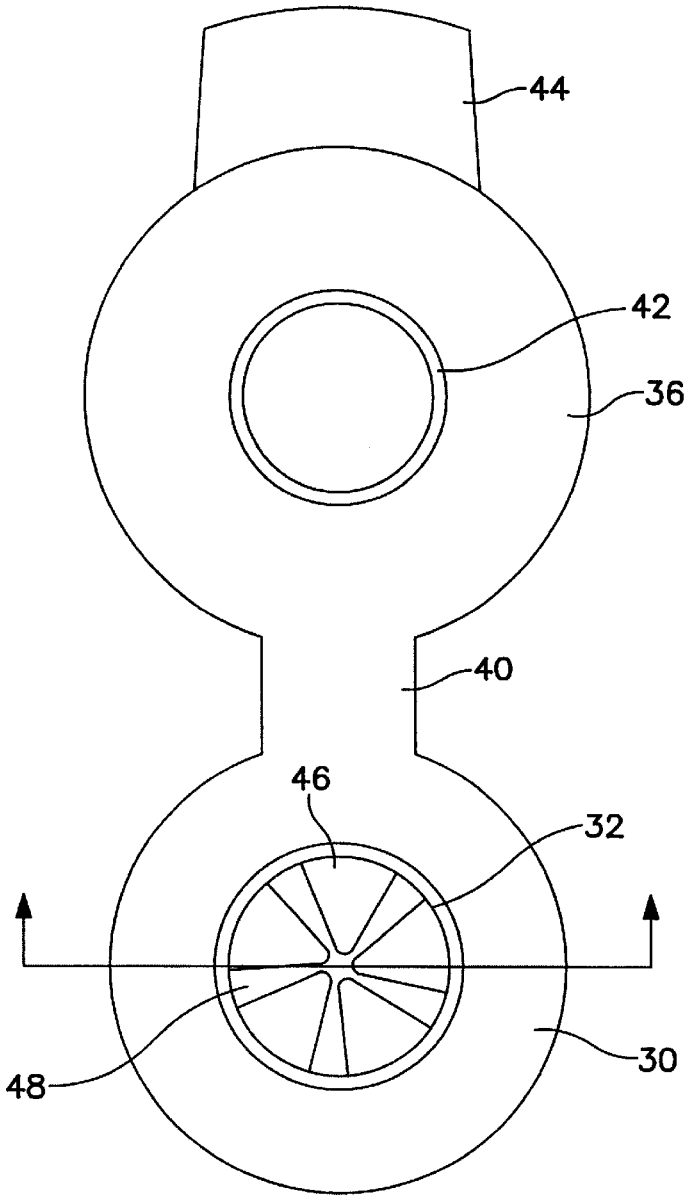
FIG. 3 depicts a top elevation of one possible configuration of a dispenser port for use with the present invention.
Figure 4:
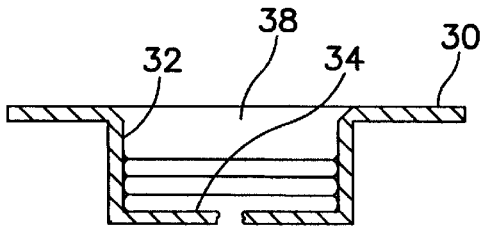
FIG. 4 depicts a side elevation of the FIG. 3 dispenser port.

As depicted in FIGS. 3 and 4, one desirable embodiment for the resealable opening 16 might comprise a flange 30 hermetically sealed to at least one flexible wall 22 or 24. Through the flange 30, a throat 32 terminating in a dispensing port 34 could allow egress of the leading end 14 of the coreless roll product 12 from the interior of the dispenser 10. A cap 36 could be disposed over the flange 30 for selectively sealing and unsealing the dispensing port 34 from the environment or enabling dispense of an individual premoistened towelette from the interior of the dispenser 10. A chamber 38 defined by the side walls of the throat 32, the dispensing port 34, and extending up to a position coplanar to the flange 30 may be disposed between the cap 36 and the interior of the dispenser 10 for capturing and staging the leading edge 14 of the roll product 12 for dispensing.

The chamber 38 enables the leading end 14 of the roll product 12 to be staged for subsequent dispensing yet does not interfere with the closure of the cap 36 thereby sealing the dispenser 10 from the environment preventing contamination or drying of the towelette. To prevent inadvertent loss of the 36 cap, the cap may be affixed to the flange 30. As shown in FIGS. 2 and 3, one manner of affixing the cap and flange is by the addition of a living hinge 40. Additionally, the cap 36 may have an annular portion 42 that engages the throat 32 thus forming a more airtight seal. A tab 44 may also be provided to enable easier grasping of the cap 36 for removal.

Other desirable features could comprise flexible tabs 46 in the dispensing port 34. The arrangement of the flexible tabs 46 could form a plurality of crossing slits 48 through which the leading end 14 of the web can be pulled. These flexible tabs 46 serve to resist the pulling action on the towelette as it is withdrawn from the dispenser 10. As the web is being pulled from the dispenser, the drag on the leading towelette caused by the flexible tabs 46 will serve to separate the towelettes at the perforations manufactured into the roll product. This separation will occur as the subsequent towelette enters the staging area formed by the chamber 38, thus staging that towelette for subsequent dispensing.

To further increase the drag associated with the withdrawal of the towelettes, the resealable opening 16 may desirably be provided in one of the side walls of the dispenser 10. This ensures that the leading end 14 of the roll product 12 will be dispensed non-axially to the central axis of the roll. It should be understood that this arrangement is not absolutely necessary but may be a desirable aspect of the present invention.

As shown in FIG. 1, the dispenser 10 could be provided with a handle 20. The handle could be formed in either or both side walls 22 and 24. The handle could be flexible and comprise the same or similar materials as the side walls. Alternatively, the handle 20 could comprise a rigid material similar to that of the cap 36. Of course the actual materials used for the handle as well as the side walls and cap are not crucial so long as they perform their intended function.

Though it is contemplated that the dispenser 10 be a single use product that is disposed of when the roll product 12 is exhausted, the dispenser 10 could be configured to accept a replacement roll 12. Looking to FIGS. 1 and 2 again, one desirable embodiment is shown further comprising a second resealable opening 50 to enable installation of a replacement roll upon exhaustion of the initial roll product 12.

This second resealable opening 50 is desirably located at one end of the dispenser 10. The second resealable opening 50 would desirably enable a user to manually access the interior of the dispenser 10 to initially stage the leading end 14 of the roll product 12 through the resealable opening 16. Additionally, in the event that the leading end 14 of the roll product 12 fell back into the dispenser 10 and was no longer accessible through the resealable opening 16, the second resealable opening 50 could be opened thus enabling restaging of the leading end 14 of the roll 12.

In the FIG. 1 variation, the second resealable opening 50 is sealed by a continuous pressure seal 52. The continuous pressure seal 52 comprises a first portion 54 in one flexible wall and a second portion 56 in an opposing flexible wall of the dispenser 10. Pressing the first and second portions 54, 56 of the continuous pressure seal 52 together hermetically seals the opening 50 from the environment. It should be understood that the continuous pressure seal 52 can be wholly contained in a single flexible wall.

Figure 5:
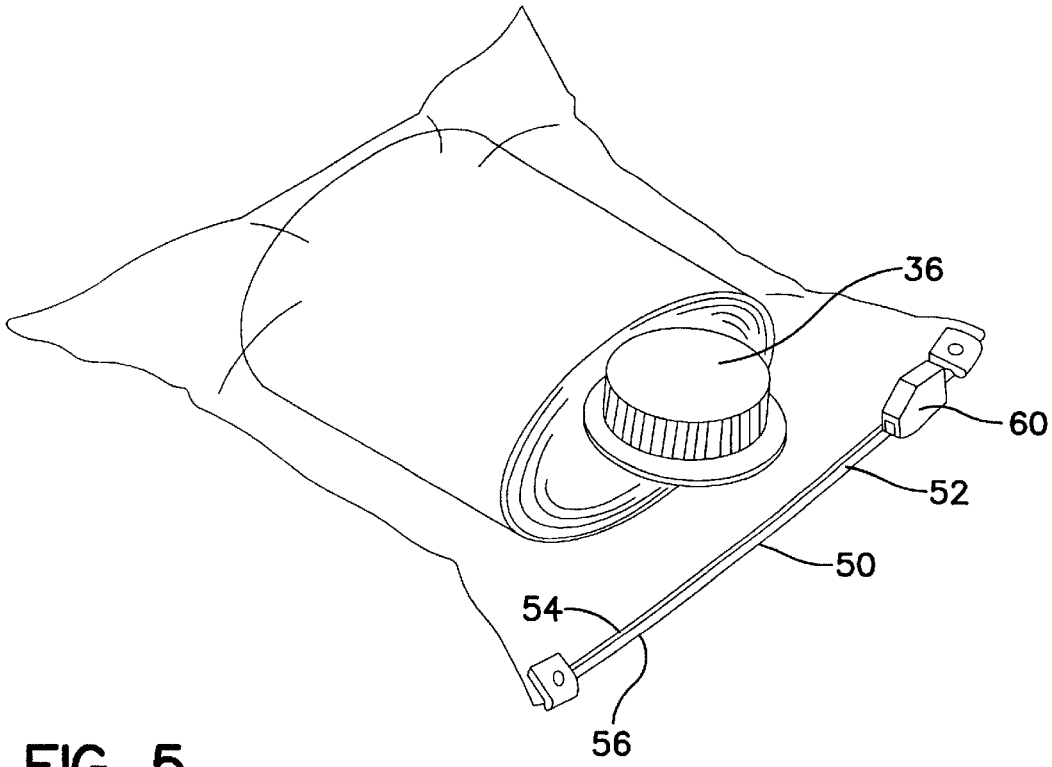
FIG. 5 is an illustration of another exemplary embodiment of a system for containing and dispensing discrete lengths of web from a continuous web of material.
Figure 6:
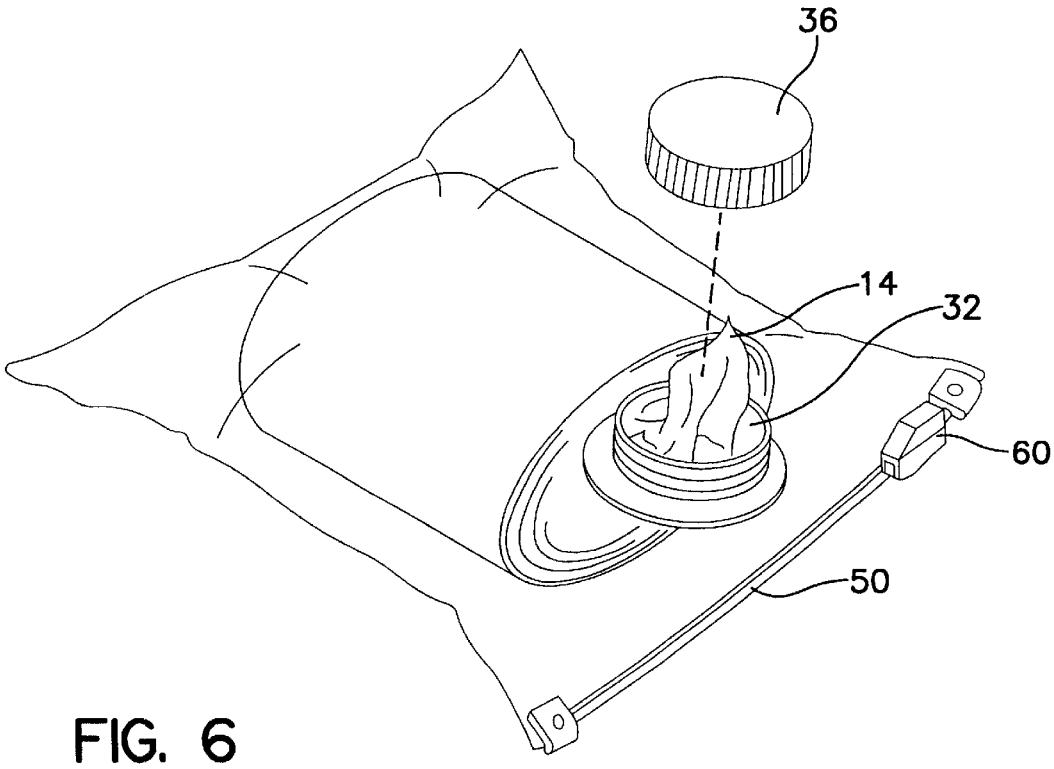
FIG. 6 is an illustration of the FIG. 5 system depicting the web in the process of being dispensed.

Referring now to FIGS. 5 and 6, a similar dispenser 10 could make use of an alternative fastening system which could comprise a zipper-like mechanism 60 that slides along the continuous pressure seal 52 mechanically fastening the first and second portions 54, 56 to one another. As should be apparent from above, the desirable characteristics of this second resealable opening 50, if provided, are that it too be adapted to hermetically seal the dispenser 10 from the outside environment.

FIGS. 5 and 6 also depict the dispenser 10 in a configuration that does not include the third flexible wall 26. This embodiment further lacks the ability to be freestanding. Furthermore, an alternative resealable opening 16 is also shown. This variation provides a cap 36 that threads, snaps onto, or otherwise externally engages the throat 32. In this variation, the throat 32 protrudes from the dispenser 10 rather than extending inward into the interior of the dispenser as in the FIG. 1 embodiment.

It should be apparent that these and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A system for dispensing wipes comprising:

a continuous web of premoistened towelettes joined at perforations and configured into a center feed roll;

a flexible, moisture impervious package for containing and dispensing individual premoistened towelettes from the continuous web, the package further comprising:

three flexible panels joined together to form an integral structure, each of the panels being joined to one another about a periphery to form a bottom flexible wall, a first side flexible wall, and a second side flexible wall within which the center feed roll is contained;

an opening through the first flexible side wall allowing access to the interior of the structure through which a leading edge of the web can be dispensed; and a resealable cap assembly disposed over the opening in the first flexible side wall sealing the opening from the environment;

a second resealable opening contiguous with at least one of said flexible panels, configured to allow access from the environment to the interior of said moisture impervious package to allow for insertion of a new center feed roll into the interior of said moisture imperious package upon exhaustion of said first center feed roll; and wherein the leading edge of the web is directed to dispense non-axially from the central axis of the roll.

2. The system of claim 1 wherein said resealable opening disposed in at least one of the panels for insertion of a new center feed roll into the interior of the structure upon exhaustion of the first center feed roll.

3. The system of claim 2 wherein the resealable opening is a seal formed between the first and the second side flexible walls.

4. The system of claim 2 wherein the resealable opening further comprises:

a first portion of a continuous pressure seal formed in a face of the first side flexible wall; and a second portion of a continuous pressure seal formed in a face of the second side flexible wall;

wherein pressing the first and second portions of the continuous pressure seal together seals the opening from the environment.

5. The system of claim 1 wherein the three flexible panels are adjoined so as to closely conform to the shape of the coreless center feed roll.

6. The system of claim 1 wherein the package is freestanding.

7. The system of claim 1 wherein the resealable cap assembly further comprises:

a flange hermetically sealed to the first flexible side wall;

a throat through the flange defining a dispensing port allowing egress of the web from the interior of the package through the opening;

a cap disposed over the flange for selectively sealing the dispensing port from the environment or enabling dispense of a discrete length of web from the interior of the package; and a chamber disposed between the cap and the interior of the package for capturing and staging the leading edge of the web for dispensing.

8. The system of claim 7 wherein the dispensing port comprises crossing slits through which the web can be pulled, while individual towelettes separate from the roll at the perforations but only after a portion of the next towelette has been exposed for grasping through the slit.

9. A system for containing and dispensing discrete lengths of web from a continuous web of material, comprising a continuous web of material joined at perforations and configured into a center feed roll;

a flexible, moisture impervious pouch for containing and dispensing discrete lengths of web from the continuous web of material configured into a roll, the pouch comprising:

a resealable opening for accessing and staging a leading edge of the roll of material adapted to dispense discrete lengths of web separated from the roll at the perforations; and a second resealable opening configured to allow access from the environment to the interior of said moisture impervious pouch to allow for insertion of a new center feed roll into the interior of said moisture impervious pouch upon exhaustion of said first center feed roll.

10. The system of claim 9 further comprising a cap assembly in cooperation with the resealable opening adapted to alternately seal and unseal the resealable opening.

11. The system of claim 9 wherein the resealable opening further comprises:

a dispensing port allowing egress of the leading edge of the roll of material from the interior of the package through the resealable opening;

a cap disposed over the dispensing port for selectively sealing the system from the environment or enabling dispense of a discrete length of web through the dispensing port; and a chamber disposed between the cap and the dispensing port for capturing and staging the leading edge of the web for dispensing.

12. The system of claim 11 further comprising a flange for attaching and hermetically sealing the cap assembly to the pouch.

13. The system of claim 9 wherein the resealable opening is adapted to direct the leading edge of the web to dispense non-axially with respect to the central axis of the roll.

14. The system of claim 9 wherein the center feed roll further comprises a continuous web of premoistened towelettes joined at perforations.

15. A system for dispensing premoistened towelettes comprising:

a continuous web of individual premoistened towelettes joined and separable at perforations and configured into a center feed coreless roll;

a flexible, moisture impervious pouch for containing and dispensing the individual premoistened towelettes, the pouch comprising:

a plurality of flexible walls peripherally joined to form a pouch having an open end to allow access from the environment to the interior of said moisture impervious pouch to allow for insertion of a new center feed coreless roll into the interior of said moisture impervious pouch upon exhaustion of said first center feed coreless roll;

a resealable sealing device disposed at the open end for sealing the open end of the pouch from the environment;

an opening through at least one of the flexible walls allowing access to the interior of the pouch through which a leading edge of the web can be staged and individual towelettes can be separated and dispensed therefrom; and a resealable cap assembly disposed over the opening through at least one of the flexible walls;

wherein the leading edge of the web is dispensed through the opening non-axially from the central axis of the coreless roll.

16. The system of claim 15 wherein the resealable sealing device further comprises:

a first portion of a continuous pressure seal formed in a first portion of the pouch; and a second portion of a continuous pressure seal formed in a second portion of the pouch;

wherein the first and second portions are adapted to mate and seal the opening from the environment.

17. The system of claim 15 wherein the resealable cap assembly further comprises:

a flange hermetically sealed to at least one flexible wall;

a throat through the flange defining a dispensing port allowing egress of the web from the interior of the pouch through the opening;

a cap disposed over the flange for selectively sealing the dispensing port from the environment or enabling dispense of an individual premoistened towelette from the interior of the pouch; and a chamber disposed between the cap and the interior of the pouch for capturing and staging the leading edge of the web for dispensing.

18. The system of claim 17 wherein the dispensing port comprises crossing slits through which the web can be pulled, while individual towelettes separate from the roll at the perforations but only after a portion of the next towelette has been exposed for grasping through the slit.

19. The system of claim 15 wherein the pouch closely conforms to the shape of the coreless center feed roll and is free-standing.

* * * * *